United States Patent [19]

Leyden

[11] Patent Number: 4,623,765

[45] Date of Patent: Nov. 18, 1986

[54] COMPUTER POWER SWITCH LOCKOUT APPARATUS

[75] Inventor: Roger J. Leyden, Willow Springs, Ill.

[73] Assignee: Se-Kure Controls, Inc., Chicago, Ill.

[21] Appl. No.: 653,434

[22] Filed: Sep. 21, 1984

[51] Int. Cl.[4] ..... F05B 17/18

[52] U.S. Cl. ..... 200/43.22; 220/210

[58] Field of Search ..... 200/42 R, 43.22; 220/210

[56] References Cited

U.S. PATENT DOCUMENTS 4,227,388 10/1980 Nigrelli et al. ..... 220/210

4,484,692 11/1984 Palermo et al. ..... 220/210

*Primary Examiner*—Stephen Marcus

*Assistant Examiner*—Renee S. Luebke

*Attorney, Agent, or Firm*—Dick and Harris

[57] ABSTRACT

A universal computer power switch lockout apparatus for permanent restrained affixation upon the exterior surface of the cabinetry of an office computer. The apparatus is positioned at a location immediately adjacent to the computer's on-off switch assembly field without penetrating the cabinetry upon installation thereof, to preclude access, as desired, to the computer's power switch, to in turn prevent unauthorized operation of the computer. A combination of flange members emanate from a mounting bracket which is positioned and adhesively affixed to the computer cabinetry surface surrounding the computer's power switch assembly field. A lockable switch enclosure is telescopically and slidingly mated with the mounting bracket to alternatively provide or restrict access to the computer's power switch enclosed thereunder. In one embodiment, an extension portion of the switch enclosure further covers a portion of the rear panel of the computer cabinet to preclude access to cabinet fastener screws and to block access to the computer's rearwardly positioned expansion modules.

13 Claims, 6 Drawing Figures

COMPUTER POWER SWITCH LOCKOUT APPARATUS

BACKGROUND OF THE INVENTION

The present invention relates generally to lockable security devices and, in particular, to a universal lockable computer power switch lockout apparatus for restrained affixation upon the exterior surface of the cabinetry of an office computer, at a location adjacent to the computer power switch.

In recent years there has been marked increase in the number of small, mini and self-contained computer products. With the growing computer literacy, there has also been an increase in the number of individuals seeking to make authorized and unauthorized use of the computer in business or educational environments. It is becoming increasingly more common for a computer to be installed in areas where a large number of people have access to, and make use of, the computer at different times. An unmonitored or uncontrolled computer installation can create difficult security problems. Controlling unauthorized use and securing portions of the computer hardware from potential theft are thus of increasing concern.

As a result of the need to provide access to such computers and at the same time insure against unauthorized use, and/or theft of componentry, various security strategies have been developed. Some of the prior art devices consisted merely of lockable cabinets enclosing the entire computer. Other prior art devices have employed security cabinets which also functioned as work stations. This type of security arrangement can often prove expensive and cumbersome often making inefficient use of available office space.

Other devices have addressed limited access to a computer's power switch. One such particular prior art device employs the use of a cast aluminum structure which encloses the computer power switch. Access to the switch is gained through opening a hinged locking door on the enclosure. Such a device is installed by clamping the enclosure to a side flange of the computer cabinet itself and by securing the hinged door-cavity apparatus with screws to the side of the cabinet to further clamp the device to the computer cabinetry.

Unfortunately however, this type of prior art security device has some potential faults which may make the device inappropriate for many computer installations. The screw fastener attachment means can potentially mar the finish of the computer cabinet resulting in an unsightly appearance should use of the device be discontinued. In some installations, access to the computer's power switch itself may be difficult or awkward as a result of the restricted access area necessitated by the structural "cavity" design of the device itself. Furthermore, this prior art device attaches to the computer cabinetry by clamping to the rear of the computer cabinetry side panel relying upon a recessed back plate. As such, this prior art device can be utilized only upon computers having their power switch located at the rear of the computer cabinetry and only upon computers having recessed back plates. This prior art device is constructed to purposefully interfere with the back plate of the computer to make it difficult to remove the plate and gain access to the circuit boards therewithin. Unfortunately, this prior art device must be completely removed from the computer each and every time authorized access is required to the rear computer circuit boards or modules for repair or maintenance. Additionally, the hinged door arrangement can potentially be pried open upwardly thereby providing unauthorized access to the computer's power switch.

Accordingly, it is an object of the present invention to provide a universal computer power switch lockout apparatus for restrained affixation upon the exterior surface of the cabinetry of a majority of computers, at a location adjacent to a switch's assembly field, without penetrating the cabinetry upon installation, to preclude access, as desired, to said computer's power switch to, in turn, prevent unauthorized operation of the computer.

It is additionally an object of the present invention to provide such a lockout apparatus which is formed by the telescopic assembly of a mounting bracket affixed to the computer cabinetry surface, and a switch enclosure, which is completely removable, thereby providing complete unobstructed access to the computer's power switch for easy manipulation of it to either its on or off position.

It is yet a further object of the present invention to provide such a computer power switch lockout apparatus which is universally adaptable for installation upon a number of different computer products which have their power switches positioned in various locations about the computer cabinetry.

Another object of the invention is to provide such a computer power switch lockout apparatus which is installed upon the computer cabinetry without penetrating the surface of said cabinetry thereby removing the risk of contacting the circuit boards therewithin. In so doing, it is an object of the invention to utilize a positive locking double sided adhesive material to secure the mounting bracket to the computer cabinetry.

Yet another object of the invention to provide such a computer power switch lockout apparatus which is easily installable upon the computer cabinetry. As part of this object, the mounting bracket and adhesive materials are configured so as to correspond to the size and shape of different power switch assemblies of various leading computer products. This configuration provides an indexing guide for prompt and proper installation of the lockout apparatus.

It is additionally an object of the present invention to provide a computer power switch lockout apparatus which has the capability of enclosing the cabinetry screws located on the back plate of the computer and preclude the removal of the back plate itself. In so doing, it is an object of the invention to have the switch enclosure be completely removable from about the switch assembly field as well as the back plate and screws thereby facilitating removal of the screws securing the rear plate of the computer, thus providing access to the circuit boards therewithin, without requiring the complete removal of the entire lockout apparatus.

As a further object, the present invention provides for a substantially secure pry-resistant construction achieved through the use of a telescopic assembly which can be manufactured in a facilitated manner, with a minimum of fabrication which mates a restraining flange with a channel construction as well as one which relies upon additional flange members to inhibit the prying apart of the lockout apparatus.

These and other objects of the invention will become apparent in light of the present specification and drawings.

SUMMARY OF THE INVENTION

The present invention comprises a universal computer power switch lockout apparatus for restrained affixation upon the exterior surface of a computer cabinet. The apparatus is placed at a location adjacent to the assembly field of the power switch itself, to preclude access, as desired, to the computer's power switch to in turn prohibit unauthorized operation of the computer. The power switch lockout apparatus itself comprises mounting bracket means which are capable of being restrainably affixed to the computer cabinet adjacent to the power switch assembly field. The mounting bracket means includes one or more mounting plate members, each of which one or more mounting plate members having one or more side flange members emanating outwardly therefrom. Mounting bracket attachment means are operably attached to each of the one or more mounting plate members for restrained affixation of these mounting plate(s) to the computer cabinetry at the location immediately adjacent to the switch assembly field without penetration of the cabinetry for attachment of same.

Switch enclosure means are provided for removably locking and covering the entire switch assembly field and mounting bracket in a closed configuration. The switch enclosure means includes an enclosure plate with one or more enclosure attachment members operably emanating inwardly from the enclosure plate. The enclosure attachment members each cooperate with each respective one of the mounting plate flange members to permit the restrained telescopic receipt of the switch enclosure means by the mounting bracket means in an alternatively covered position in which the power switch assembly field and mounting bracket means are covered and inaccessible, as well as in an open position in which the mounting bracket means and power switch assembly field and, in turn, the power switch, is accessible to alternatively preclude or provide access to the computer power switch as desired. Position locking means are operably positioned in one or both of the switch enclosure means and mounting bracket means to maintain the enclosure means in its alternative covering position to provide locking enclosure and in turn preclude access to the switch and mounting bracket. One or more of the switch enclosure and mounting bracket means further include switch assembly field anti-tamper barrier means to further preclude attempts at unauthorized removal of the switch enclosure means or operation of the power switch when the switch enclosure is located in its affixed covering lockout position. The mounting bracket means further maximizes access to the power switch when the switch enclosure is in the alternative open access position and is of such a relative minimum depth to facilitate operational manipulation of the power switch even while located immediately adjacent thereto.

In the preferred embodiment, the mounting bracket means comprises a substantially U-shaped three sided bracket element for positioning and affixation to the computer cabinetry immediately adjacent to the top, left and bottom sides of the power switch assembly field. This U-shaped three sided bracket element possesses a top, left and bottom side portion respectively aligned with the top, left and bottom sides of the power switch assembly field respectively. Each of the side flange members emanate from one or more of the top, left and/or bottom of the U-shaped bracket element. Preferably, the mounting bracket means includes a top side flange means emanating outwardly from the top portion of the mounting plate and a bottom side flange means emanating outwardly from the bottom portion of the mounting plate means in an environment in which the top side flange means is located substantially opposite to the bottom side flange means. Each of the top and side flange means, in this preferred embodiment, further embody a top restraining flange element which emanates upwardly from the outermost edge of the top side flange means with the bottom restraining flange element emanating downwardly from the outermost edge of the bottom side flange means.

In one embodiment the mounting bracket attachment means comprises a double sided adhesive member which is operably attached to the innermost surface of the mounting plate means and the exterior surface of the computer cabinetry at a location immediately adjacent the power switch assembly field to firmly and restrainably affix and anchor the mounting bracket means to the exterior surface of the computer cabinetry without penetrating the surface of the cabinetry. Alternatively, the mounting bracket attachment means comprises a fluid bonding adhesive positioned upon the innermost surface of the mounting plate and, equivalently, on the exterior surface of the computer cabinetry at a location immediately adjacent the power switch assembly field to again, firmly and restrainably affix and anchor the mounting bracket to the computer cabinetry without penetrating same.

In the above described preferred embodiment of the invention, the enclosure attachment members include a top attachment member which emanates inwardly proximate to the lower surface of the enclosure plate means, from the top edge of the enclosure plate, so as to form a top channel member capable of being telescopically received by the top restraining flange emanating from the mounting bracket and, a bottom attachment member emanating inwardly proximate to the lower surface of the enclosure plate means, from the bottom edge of the enclosure plate, so as to form a bottom channel member capable of being telescopically received by the bottom restraining flange element of the bracket means, with the top channel member being positioned substantially opposite to the bottom channel member along the top and bottom edges of the enclosure plate means, respectively. In this embodiment the top and bottom restraining flange elements are operably aligned with each of the top and bottom channel members respectively to permit the overall telescopic receipt of the switch enclosure means by the mounting bracket means through the leftward sliding of the switch enclosure means over the mounting bracket, along the longitudinal axis of the top and bottom restraining flange elements, so as to further preclude the switch enclosure means from being pried off outwardly from the mounting bracket means.

The locking means utilized in the present invention comprise cylinder lock means operably mounted within the enclosure plate, the cylinder lock means having a locking cam member positionable in alternative positions substantially adjacent to and substantially apart from the mounting bracket means. The locking means further includes a locking tab member which is operably mounted to the outermost surface of the mounting bracket's mounting plate, for alternative striking and locking, or missing and releasing, the locking cam member, depending upon which position the locking cam member is turned to. Through such a construction the apparatus may be alternatively locked and unlocked by alternatively maintaining and/or releasing the switch enclosure means from its closed position. The locking means further include a locking switching member which cooperates with the cylinder lock to enable rotation of the locking cam member into a locked or unlocked position, such as through operable key locking means.

In the preferred embodiment of the invention the anti-tamper barrier means comprises a first barrier plate extending inwardly from the right edge of the switch enclosure plate to the exterior surface of the computer cabinetry to prevent unauthorized access to the power switch assembly field by further enclosing the rightmost space between the mounting bracket when the switch enclosure means when located in the alternative covered position. In one embodiment, this first barrier plate means further comprises a first barrier extension member extending inwardly from the inwardmost edge of the first barrier plate means so as to enable the first barrier extension to cover a rear portion of the computer cabinetry where this rear portion is substantially transverse to the exterior cabinet surface, as well as cover any adjacent cabinet attachment fastening devices positioned therewithin. The barrier extension member thus precludes access to the adjacent cabinet attachment fasteners while precluding unauthorized removal of the rear portion of the computer cabinet from its adjacent cabinet surface to maintain inaccessible, any circuit boards and expansion modules positioned therewithin the rear portion. In another embodiment this extension member futher includes a barrier flange plate emanating toward the rear portion from the innermost edge of the barrier plate extension member so as to substantially abut the rear portion of the computer cabinetry to, in turn, further prevent access to the adjacent cabinet attachment fasteners and preclude the unauthorized removal of the rear portion of the computer cabinet from its adjacent cabinet surface—all to further maintain, in an inaccessible environment, the circuit boards and expansion modules positioned within the rear portion of the computer cabinet.

In another embodiment of the invention the anti-tamper means comprises a second barrier plate means emanating outwardly from the leftmost edge of the mounting plate means, extending outwardly a distance substantially equal to the height of the top and bottom flange means so as to restrict access to the computer power switch assembly field by substantially sealing the leftmost opening between the mounting bracket and the switch enclosure means. Additionally, in the preferred embodiment, this second barrier plate means further includes a second barrier restraining member emanating toward the right from the outermost edge of the second barrier means to a position capable of overlapping the leftmost edge of the enclosure plate means when the switch enclosure means is in its alternatively closed position, thereby further preventing the switch enclosure means from being pried away from the mounting bracket means in an outward direction.

Additionally, in the preferred embodiment of the invention the mounting plate means is configured so as to be capable of restrained affixation to the computer cabinetry adjacent to the power switch assembly field regardless of the computer manufacturer's location of the power switch along its cabinet. Through such a construction, the actual configuration of the mounting plate directly corresponds to the size and shape of various standard power switch assembly fields so as to provide an accurate index for installation of the mounting bracket means thereabout, to in turn prompt the proper installation of the mounting bracket means and in turn the overall computer power switch lockout apparatus. Additionally, it is contemplated that the mounting bracket means and the switch enclosure means are fabricated of a substantially hardened steel material so as to effectively preclude access to the computer power switch assembly field when positioned thereover, in said alternative closed position, and to further restrict prying or attempted breakage of same towards unauthorized access to the computer's power switch.

DETAILED DESCRIPTION OF THE DRAWINGS

Figure 1:
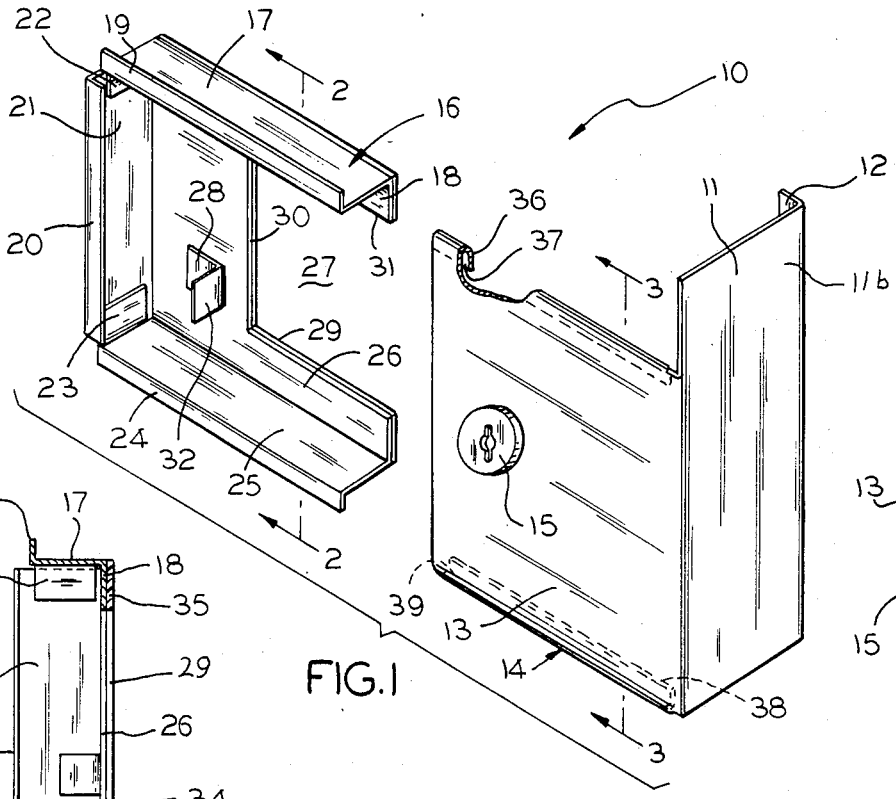
FIG. 1 of the drawings is an exploded side-perspective view of the present computer switch lockout apparatus illustrating the telescopic assembly of the mounting bracket and switch enclosure and detailing the restraining flanges and corresponding channels which permit the telescopic assembly.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiment illustrated.

Computer power switch lockout apparatus 10 is shown in FIG. 1 in its open position, with switch enclosure 14 being separated from mounting bracket 16. Mounting bracket 16 telescopically receives switch enclosure 14 upon assembly of the computer power switch lockout apparatus so as to enclose the computer power switch thus preventing unauthorized operation of the computer.

Mounting plate 26 is affixed to the exterior surface of the computer cabinetry immediately surrounding the power switch assembly field. Mounting plate 26 has a notch 27, along its rightmost side defined by edges 29, 30 and 31. Notch 27 will vary in size and shape in different embodiments of mounting bracket 16, to accommodate the differently shaped computer power switch assembly fields of various computer products. Notch 27 serves, among other things, as a guide for the prompt and proper installation of mounting bracket 16 to the exterior surface of the computer cabinetry.

Emanating upwardly from the outward edge of the top side flange 17 is the top restraining flange element 19. Emanating downwardly from the outward edge of the bottom side flange 25 is the bottom restraining flange element 24. Restraining elements 19 and 24 serve to operably permit telescopic assembly of switch enclosure 14 and mounting bracket 16.

Switch enclosure 14 is comprised mainly of enclosure panel 13 and top and bottom channel members 36 and 38. Channel members 36 and 38 are positioned and aligned with restraining members 19 and 24 respectively so as to permit the telescopic assembly of the computer power switch lockout apparatus by sliding switch enclosure 14 toward the left, thus overlapping the entire mounting bracket 16. Top channel space 37 and bottom channel space 39 correspond to the thickness of the material forming the top and bottom restraining members 19 and 24 serving to permit smooth but secure assembly.

Cylinder lock 15 is mounted to enclosure plate 13 and locking tab 32 is mounted to mounting plate 26. Locking tab 32 and cylinder lock 15 are positioned and aligned such that when cylinder lock 15 is in the locked position switch enclosure 14 cannot be separated from mounting bracket 16 thereby preventing unauthorized operation of the computer's power switch.

Emanating inwardly from the rightmost edge of enclosure plate 13 is barrier plate 11. FIG. 1 illustrates an embodiment of the invention in which barrier plate 11 includes barrier plate extension **11*b* as well as barrier flange plate 12 which emanates toward the rear portion of the computer cabinet from the innermost edge of said barrier plate extension 11*b*. This embodiment of the invention is designated for use upon a computer which has its power switch positioned along the rear of the computer cabinetry surface. The barrier plate extension 11*b* extends beyond the edge of the computer cabinetry surface thereby covering a portion of the rear of the cabinetry so as to inhibit the removal of the computer's rear panel thus securing the circuit boards and modules contained therewithin. Barrier flange plate 12 prevents barrier plate 11** from being pried away from the computer cabinetry surface.

Emanating outwardly from the leftmost edge of mounting plate 26 is second barrier plate 21. Second barrier plate 21 extends outwardly a distance substantially equal to the top and bottom side flanges 17 and 25 so as to restrict access to the computer power switch assembly field by substantially sealing off the leftmost opening between mounting bracket 16 and switch enclosure 14 when same are in their covered position.

Emanating toward the right from the outermost edge of the second barrier plate 21 is the second barrier restraining member 20. Second barrier restraining member 20 serves to overlap the leftmost edge of switch enclosure 14 when switch enclosure 14 is in the closed position, thereby further preventing switch enclosure 14 from being pried away from mounting bracket 16.

Figure 2:
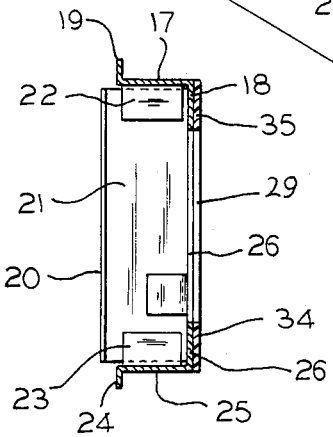
FIG. 2 of the drawings is a front cross-sectional view of the mounting bracket means taken along line 2—2 of FIG. 1 and looking in the direction of the arrows, specifically illustrating the top and bottom side flanges, top and bottom restraining flanges and mounting plate, as well as the double sided adhesive material used therewith.

FIG. 2 shows the double sided adhesive material 26. The double sided adhesive material 29 is affixed to the inward side of mounting plate 26 for securing mounting bracket 16 to the surface of the computer cabinetry. Adhesive material 29 is of substantially the same size and shape as mounting plate 26, being notched to directly correspond to the size and shape of the particular computer's power switch assembly field to permit a prompt, proper and clean installation of the computer power switch lockout apparatus 10. In the embodiment illustrated in FIG. 2 a top side weld flange 22 and bottom side weld flange 23 are shown emanating from the leftmost edges of the top and bottom side flanges respectively, each weld flange overlapping second barrier plate 21. Top side weld flange 22 and bottom side weld flange 23 provide some additional rigidity to the corners of mounting bracket 16.

Figure 3:
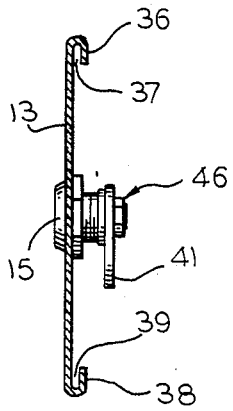
FIG. 3 is a front cross-sectional view of the switch enclosure means taken along line 3—3 of FIG. 1 and looking in the direction of the arrows, specifically illustrating the top and bottom channels and cylinder lock means thereof.

FIG. 3 illustrates the top and bottom channel members 36 and 38 which are aligned with the top and bottom restraining members 19 and 24, respectively, to permit the telescopic assembly of the lockout apparatus 10. Cylinder lock 15 is shown mounted upon enclosure plate 13. Locking cam member 32, to in turn lock and unlock, respectively, the computer power switch lockout apparatus.

Figure 4:
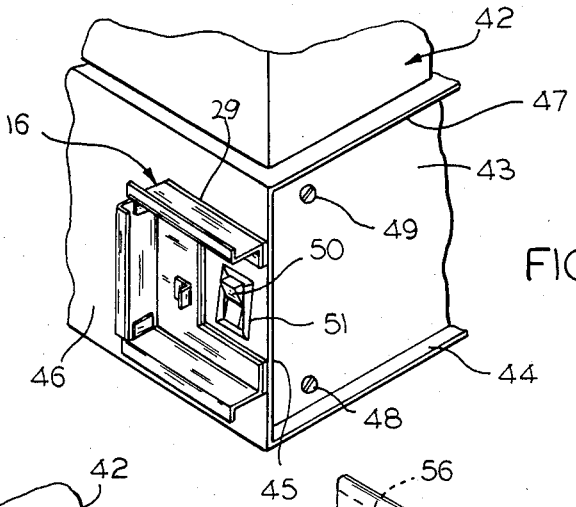
FIG. 4 of the drawings is a side perspective view of the mounting bracket means shown in its affixed position surrounding the computer power switch assembly field located at the rear of the computer cabinetry.

FIG. 4 illustrates mounting bracket 16 being positioned and restrainably affixed to the exterior surface of the computer cabinetry side panel 46 at a location immediately adjacent to the switch assembly field 51. In this particular installation the power switch 50 is located at the rear of the computer cabinetry side panel 46, however, mounting bracket 16 can be positioned and affixed to the computer cabinetry should the power switch 50 be located in other positions. The double sided adhesive material 29 is shown interposed between the computer cabinetry surface 46 and mounting bracket 16. It is apparent how notch 27 of mounting bracket 16 permits a mounting bracket 16, and in turn, lockout apparatus 10 to be properly installed by acting as a guide, as the notch dimensions correspond to the size and shape of the computer power switch assembly field 51. With switch enclosure 14 removed, the ready accessiblity of power switch 50 becomes apparent as no portion of mounting bracket 16 interferes with the operation of power switch 50. Additionally, with switch enclosure 14 removed there is nothing to interfere with the removal of the computer's back panel.

Figure 5:
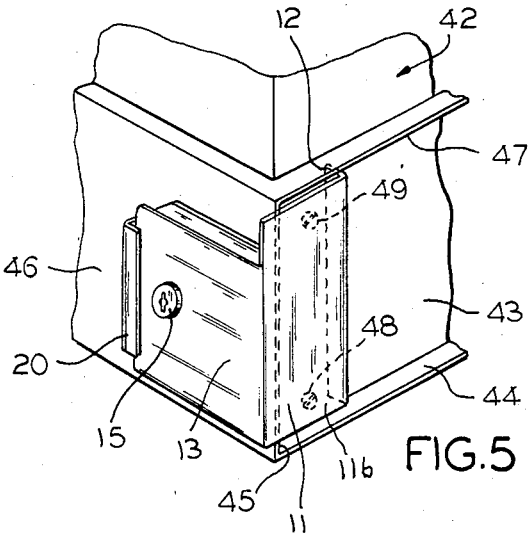
FIG. 5 is a side perspective view of the assembled computer switch lockout apparatus in its closed position lockably enclosing a rearwardly located power switch assembly and further precluding access to the computer's cabinetry screws and back plate.

The fully assembled computer power switch lockout apparatus 10 is illustrated in its fully closed position in FIG. 5. Enclosure plate 13 fully covers and encloses the computer power switch assembly field 51 upon the telescopic assembly of the lockout apparatus 10. In the covered position, the left edge of enclosure plate 13 is overlapped by the second barrier restraining member 20. The pry-resistant nature of this overlap arrangement is thus apparent. The embodiment illustrated includes a barrier plate 11 which substantially seals the rightmost side of mounting bracket 16 and further includes barrier plate extension **11*b* which further encloses computer cabinetry screws 48 and 49. Barrier flange plate 12 is shown abutting the rear portion of the computer cabinet 43. The protection against prying off barrier plate 11** thus becomes apparent.

Figure 6:
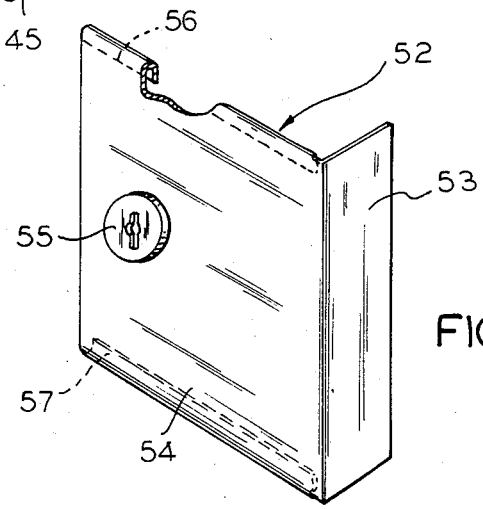
FIG. 6 of the drawings is a side perspective view showing an alternative embodiment of switch enclosure means specifically possessing a barrier plate member which does not extend beyond the surface of the computer cabinet, upon telescopic receipt by the mounting bracket to preclude covering the rear of the computer cabinetry, for universal placement along any portion of the cabinet.

FIG. 6 illustrates an alternative embodiment of switch enclosure 14. In instances where the computer power switch 50 is centrally located upon the computer cabinetry there would be need only to enclose the rightmost side of the mounting bracket 16. As such, the switch enclosure 52 provides for a barrier plate 53 to substantially enclose the computer power switch assembly field 51.

The foregoing description and drawings merely explain and illustrate the invention and the invention is not limited thereto, except insofar as the amended claims are so limited as those skilled in the art who have the disclosure before them will be able to make modifications and variations therein without departing from the scope of the invention. For example, it is within the scope of the invention to reverse the positions of the "left" and "right" sides of the apparatus should the device be mounted on the opposite side of a computer's cabinetry with the realization that, regardless of which side that the lock-out apparatus is mounted on, there will still exist a forwardmost side (towards the front of the computer cabinet) as well as a rearwardmost side (towards the back or rear of the computer cabinet).

What is claimed is:

1. A universal computer power switch lockout apparatus for restrained affixation upon the exterior surface of a computer's cabinetry at a location adjacent to said computer's power switch assembly field to preclude access, as desired, to said computer's power switch, circuit boards and expansion modules to, in turn, prevent unauthorized operation of the computer, said computer power switch lockout apparatus comprising:

mounting bracket means for mounting said lockout apparatus to said computer, said mounting bracket means being capable of restrained affixation to said computer cabinetry adjacent to said power switch assembly field, said mounting bracket means including one or more mounting plate means, each of said one or more mounting plate means having one or more side flange members emanating outwardly therefrom, mounting bracket attachment means operably attached to each of said one or more mounting plate means for said restrained affixation of said mounting plate means to said computer cabinetry at said location immediately adjacent to said switch assembly field without penetration of said cabinetry for attachment thereof;

switch enclosure means for lockably and removably covering the entire switch assembly field and said mounting bracket means, said switch enclosure means including enclosure plate means and one or more enclosure attachment members operably emanating inwardly from said enclosure plate means, each of said enclosure attachment members cooperating with each of said one or more mounting plate flange members respectively to permit the restrained telescopic receipt of said switch enclosure means by said mounting bracket means alternatively in a covered position, in which said power switch assembly field, said power switch, said mounting bracket means, said circuit boards and said expansion modules are covered and inaccessible, and in an open position in which said mounting bracket means, said power switch assembly field, said power switch, said circuit boards and said expansion modules are accessible, to alternatively preclude and provide access to same, as desired, position locking means operably positioned in one or both of said switch enclosure means and said mounting bracket means, for maintaining said enclosure means in said covered position to provide locking closure and, in turn, preclude access to said switch and mounting bracket, as desired, said switch enclosure means further including anti-tamper barrier means to further preclude attempts at unauthorized removal of said switch enclosure means, operation of said power switch when said switch enclosure is located in said affixed, covering lockout position, and access to circuit boards and expansion modules at the rear, said anti-tamper barrier means comprising first barrier plate means for enclosing and covering said circuit boards and expansion modules at the rear of said computer cabinetry, said first barrier plate means extending inwardly from the rearmost edge of said enclosure plate means towards and past the rearmost portion of said mounting plate means to further preclude access to said power switch assembly field, as well as to cover at least a portion of the rear of said computer cabinetry substantially transverse to said exterior surface and any adjacent cabinet attachment fastening devices positioned therewithin, and said first barrier plate means precluding access to said adjacent cabinet attachment fasteners to preclude the unauthorized removal of the rear portion of the computer cabinet from its adjacent cabinet surfaces, while maintaining said circuit boards and expansion modules inaccessible when said switch enclosure means is in alternative covered position, and alternatively providing access to said power switch when said switch enclosure means is in said alternative open position without the need to alternatively remove, reposition and displace said mounting bracket means.

2. The invention according to claim 1 in which said mounting bracket attachment means comprises a double sided adhesive member operably attached to the innermost surface of said mounting plate means and said exterior surface of said computer cabinetry at said location immediately adjacent said power switch assembly field, to firmly and restrainably affix and anchor said mounting bracket means to the exterior surface of said computer cabinetry without penetration of same.

3. The invention according to claim 1 in which said mounting bracket attachment means comprises a fluid bonding adhesive positioned upon the innermost surface of said mounting plate means and said exterior surface of said computer cabinetry at said location immediately adjacent said power switch assembly field, to firmly and restrainably affix and anchor said mounting bracket means to the exterior surface of said computer cabinetry without penetration of same.

4. The invention according to claim 1 in which said locking means comprises cylinder lock means operably mounted within said enclosure plate means, said cylinder lock means having a locking cam member positionable in alternative positions substantially adjacent to and apart from said mounting bracket means, said locking means further including a locking tab member operably mounted to the outermost surface of said mounting bracket means for alternatively striking and releasing said locking cam member, to in turn, lock and unlock, respectively, said computer power switch lockout apparatus by alternatively locking and releasing respectively said switch enclosure means from its closed position, said locking means further including a locking switching member which cooperates with said cylinder lock means to rotate said locking cam member into a locked or unlocked position.

5. The invention according to claim 1 in which said first barrier plate means further includes a barrier flange plate emanating toward said rear portion from the innermost edge of said barrier plate means so as to substantially abut said rear portion of said computer cabinetry to, in turn, further prevent access to said adjacent cabinet attachment fasteners and preclude the unauthorized removal of the rear portion of the computer cabinet from its adjacent cabinet surfaces, to maintain inaccessible, any circuit boards and expansion modules positioned therewithin said rear portion.

6. The invention according to claim 1 in which said mounting plate means is configured so as to be capable of restrained affixation to said computer cabinetry adjacent to the power switch assembly field of various manufacturers of computer products, said configuration directly corresponding to the size and shape of various standard power switch assembly fields so as to provide an accurate index for the placement of said mounting bracket means thereabout, to in turn prompt the proper installation of said mounting bracket means, and, in turn said computer power switch lockout apparatus.

7. The invention according to claim 1 in which said mounting bracket means and said switch enclosure means are fabricated of a substantially hardened steel material so as to effectively preclude access to said computer's power switch assembly field when positioned thereover in said alternative closed position.

8. The invention according to claim 1 in which the mounting plate means of said mounting bracket means comprises a single substantially U-shaped three sided plate element for positioning and affixation to said computer cabinetry immediately adjacent to the top, forward and bottom sides of said power switch assembly field, said U-shaped three sided plate element having a top, forward and bottom side portion respectively aligned with the top, forward and bottom sides of said power switch assembly field respectively;

each of said side flange members emanating from one or more of said top, forward and bottom side portions.

9. The invention according to claim 8 in which said mounting bracket means includes top side flange means emanating outwardly from the top portion of said mounting plate means, bottom side flange means emanating outwardly from the bottom portion of said mounting plate means, and a forward side flange means emanating outwardly from the forward portion of said mounting plate means, said top side flange means being located substantially opposite to said bottom side flange means, said top side flange means further including a top restraining flange element emanating upwardly from the outermost edge of said top side flange means, said bottom side flange means further including a bottom restraining flange element emanating downwardly from the outermost edge of said bottom side flange means.

10. The invention according to claim 9 in which said enclosure attachment members includes a top attachment member emanating inwardly proximate to the bottom surface of said enclosure plate means from the top edge of said enclosure plate means so as to form a top channel member capable of being telescopically received by said top restraining flange element of said mounting bracket means, a bottom attachment member emanating inwardly proximate to the lower surface of said enclosure plate means from the bottom edge of said enclosure plate means so as to form a bottom channel member capable of being telescopically received by said bottom restraining flange element, said top channel member being positioned substantially opposite to said bottom channel member along the top and bottom edges of said enclosure plate means respectively.

11. The invention according to claim 10 in which said top and bottom restraining flange elements are operably aligned with each of said top and bottom channel member, respectively, to permit the overall telescopic receipt of said switch enclosure means by said mounting bracket means through the forward sliding of said switch enclosure means over said mounting bracket means, along the longitudinal axis of said top and bottom restraining flange elements, so as to further preclude said switch enclosure means from being pried off outwardly from said mounting bracket means.

12. The invention according to claim 9 in which said forward side flange means extends outwardly from said mounting plate means, a distance substantially equal to said top and bottom side flange means so as to restrict access to the computer power switch assembly field by substantially sealing the forwardmost opening between said mounting bracket means and said switch enclosure means.

13. The universal computer power switch lockout apparatus of claim 12 in which said forward side flange means further includes a second barrier restraining member emanating toward the rear from the outermost edge of said forward side flange means, said second barrier restraining member positioned to overlap the forwardmost edge of said enclosure plate means when said switch enclosure means is in the alternatively closed position thereby further preventing said switch enclosure means from being pried away from said mounting bracket means.

* * * * *